United States Patent [19]

Tajima et al.

[11] Patent Number: 4,924,789

[45] Date of Patent: May 15, 1990

[54] DEVICE FOR DRIVING A THREAD TAKE-UP LEVER IN A MULTI-HEAD SEWING MACHINE

[75] Inventors: Ikuo Tajima, Nagoya; Tomoaki Anezaki, Kasugai, both of Japan

[73] Assignee: Tokai Kogyo Mishin Kabushiki Kaisha, Kasugai, Japan

[21] Appl. No.: 369,640

[22] Filed: Jun. 21, 1989

[30] Foreign Application Priority Data

Jul. 14, 1988 [JP] Japan ..... 63-175538

[51] Int. Cl.[5] ..... D05B 49/02

[52] U.S. Cl. ..... 112/241; 112/98; 112/155

[58] Field of Search ..... 112/57, 80.43, 80.44, 112/96, 98, 155, 163, 167, 221, 241, 242, 243, 244, 245, 246, 247, 248, 249, 250, 452, 455

[56] References Cited

U.S. PATENT DOCUMENTS

| | | | |
|---|---|---|---|
| 3,266,448 | 8/1966 | Haggar | 112/221 X |
| 3,595,188 | 7/1971 | Schmedding | 112/221 |
| 3,884,165 | 5/1975 | Tajima | 112/221 X |
| 4,369,721 | 1/1983 | Bolldorf et al. | 112/98 |
| 4,412,497 | 11/1983 | Teetz et al. | 112/96 |
| 4,531,467 | 7/1985 | Golia, Jr. et al. | 112/247 X |
| 4,719,865 | 1/1988 | Yokoe et al. | 112/163 X |

FOREIGN PATENT DOCUMENTS

| | | | |
|---|---|---|---|
| 71759 | 4/1985 | Japan | 112/241 |
| 470708 | 8/1937 | United Kingdom | 112/250 |

*Primary Examiner*—Werner H. Schroeder
*Assistant Examiner*—David K. Suto
*Attorney, Agent, or Firm*—Dennison, Meserole, Pollack & Scheiner

[57] ABSTRACT

A device for driving a thread take-up lever in a multi-head sewing machine having a plurality of sewing heads, one or more thread take-up levers each mounted on a respective head, and a main shaft for driving the heads. The device comprises a movement converting mechanism located within each head for converting rotational movement of the main shaft into reciprocating movement thereof, a transmission control mechanism operatively associated with the movement converting mechanism for transmitting and disconnecting the reciprocating movement produced by the movement converting mechanism to one of the thread take-up levers selected for sewing operation, and a retaining mechanism for retaining the selected take-up lever in a predetermined position when the reciprocating movement of the movement converting mechanism is disconnected from the selected take-up lever by the transmission control mechanism.

5 Claims, 5 Drawing Sheets

DEVICE FOR DRIVING A THREAD TAKE-UP LEVER IN A MULTI-HEAD SEWING MACHINE

BACKGROUND OF THE INVENTION

The present invention relates to a multi-head sewing machine including a plurality of sewing heads, and more particularly to a device for driving a thread take-up lever of each of the heads.

In a multi-head sewing machine in which thread take-up levers of the sewing heads are arranged to be driven by a common main shaft, when some of the sewing heads stop their sewing operation, the respective thread take-up levers still continue their swinging movement while the main shaft is rotated.

In such a sewing head held at rest, the needle thread guided through the corresponding thread take-up lever tends to be entangled by the swinging movement of the thread take-up lever of fluffed under the effect of repeated sliding friction of the thread take-up lever and consequently, it will be broken or slip out of the needle.

SUMMARY OF THE INVENTION

It is, accordingly, a general object of the present invention to eliminate the aforenoted disadvantages associated with the prior art.

It is a more specific object of the present invention to provide a thread take-up lever driving device in a multi-head sewing machine which may reliably retain a thread take-up lever in its rest position.

According to the present invention, there is provided a device for driving a thread take-up lever in a multi-head sewing machine having a plurality of sewing heads, one or more thread take-up levers each mounted on a respective head, and a main shaft for driving the heads. The device comprises a movement converting mechanism located within each head for converting rotational movement of the main shaft into reciprocating movement thereof, a transmission control mechanism operatively associated with the movement converting mechanism for transmitting and disconnecting the reciprocating movement produced by the movement converting mechanism to one of the thread take-up levers selected for sewing operation, and a retaining mechanism for retaining the selected take-up lever in a predetermined position when the reciprocating movement of the movement converting mechanism is disconnected from the selected take-up lever by the transmission control mechanism.

When the transmission control mechanism of each head of the multi-head sewing machine is operated to interrupt transmission of the driving force from the main shaft to a corresponding thread take-up lever, the thread take-up lever of the head stops its swinging movement and is non-swingably retained by the retaining mechanism. When the transmission control mechanism of the head is operated to resume transmission of the driving force from the main shaft to the thread take-up lever, the retaining mechanism releases the thread take-up lever from its retained position to thereby permit swinging movement of the thread take-up lever.

With this arrangement, when some of the heads are brought to their rest position to stop sewing operation, the respective thread take-up levers stop their swinging movement which would otherwise cause troubles such as entanglement and fluffing of the needle threads, and thus, the heads can subsequently restart their sewing operation without making the noted troubles which would be caused by continuous swinging movement of the thread take-up levers. Further, the thread take-up lever restrained from swinging movement can be effectively prevented from undesired tilting movement caused by its dead weight.

The invention will become more fully apparent from the claims and the description as it proceeds in connection with the drawings.

DETAILED DESCRIPTION OF THE PREFERRED EMBODIMENT

Figure 1:
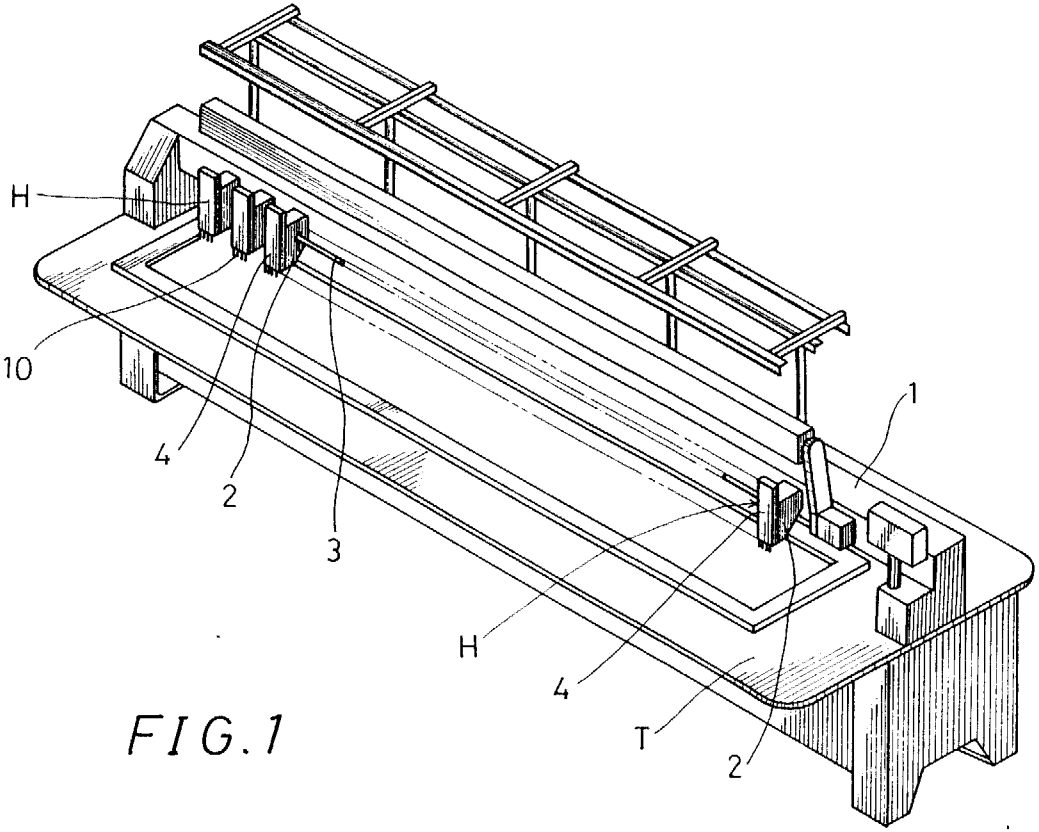
FIG. 1 is a somewhat simplified perspective view of a multi-head sewing machine embodying the principles of the present invention, only four of the sewing heads of the machine being shown.
Figure 2:
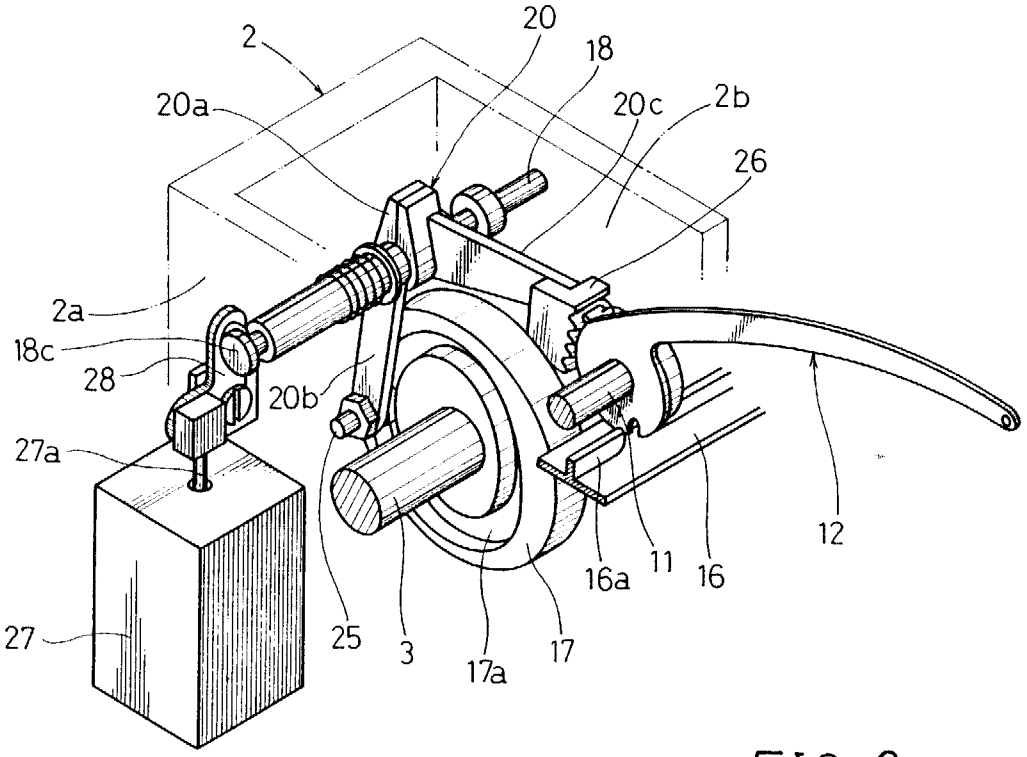
FIG. 2 is an enlarged perspective view of the essential parts of the head of the machine.
Figure 3:
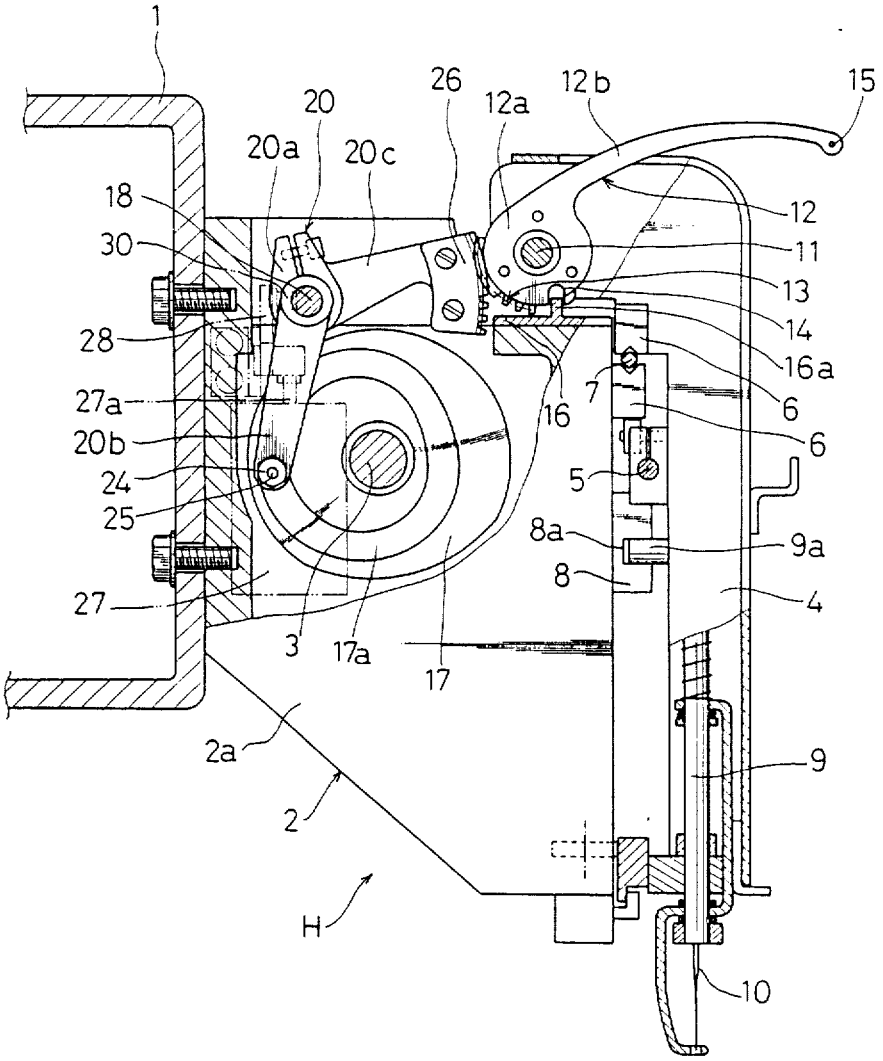
FIG. 3 is a side view partly in cross section of the essential parts of the head.

Referring now to drawings, and more particularly to FIGS. 1 to 3, there is shown a multi-head sewing machine embodying the principles of the present invention. As shown therein, the sewing machine includes a frame 1 horizontally disposed on a table T. A plurality of sewing heads H are horizontally disposed in front of the frame 1 in longitudinally spaced relation to each other. Each of the heads H includes a bracket arm 2 and a needle bar case 4.

The arm 2 is secured to the front end surface of the frame 1 and, as specifically shown in FIG. 2, has side walls **2*a* and 2*b* extending forwardly therefrom. A main shaft 3 extends through the respective arms 2 of the heads H. The main shaft 3 is rotatably supported by the arms 2 and is driven for rotation by a driving motor (not shown). As shown in FIG. 3, the needle bar case 4 is mounted on the front end surface of the arm 2 and is connected to a driving rod 5 controlled to be axially moved by a driving mechanism (not shown). The needle bar case 4 is longitudinally slidable in a horizontal plane through upper and lower rails 6 and a linear bearing 7**.

A needle bar driving member 8 is vertically movably mounted on a longitudinally central portion of the front end of the arm 2. Rotation of the main shaft 3 is transmitted to the needle bar driving member 8, so that the needle bar driving member 8 may be steadily driven for vertical movement. The needle bar driving member 8 is formed with an engaging recess **8*a*** of a forwardly open U-shaped configuration.

A plurality of needle bars 9 (six in this embodiment) are vertically movably supported in the needle bar case 4 and are disposed parallel to one another. Each of the needle bars 9 carries a needle 10 secured to the lower end thereof. When the driving rod 5 to which the needle bar case 4 is connected is driven, the needle bar case 4 is longitudinally moved, until a desired one of the six needle bars 9 is located in front of the needle bar driving member 8. Thus, one of the needle bars 9 to be used may be selected. Each of the needle bars 9 is provided with an interlocking stub 9a projecting backwardly from the rear side thereof to be inserted from laterally into the recess 8a in the needle bar driving member 8, so that rotation of the main shaft 3 will cause the selected needle bar 9 to be driven for reciprocation through the needle bar driving member 8 to perform a sewing operation by the corresponding needle. The needle bars 9 other than the selected one are held in their rest position at a predetermined height. When the head H is desired to stop its sewing operation, an operating member (not shown) is operated by a needle bar stop signal to rotate the needle bar driving member 8 through an angle of substantially 90° about the vertical axis thereof, so that the interlocking stub 9a of the needle bar 9 is disengaged from the engaging recess 8a, and the needle bar 9 is held inoperative, even when the main shaft 3 is rotated and concomitantly the needle bar driving member 8 is vertically moved.

Figure 4:
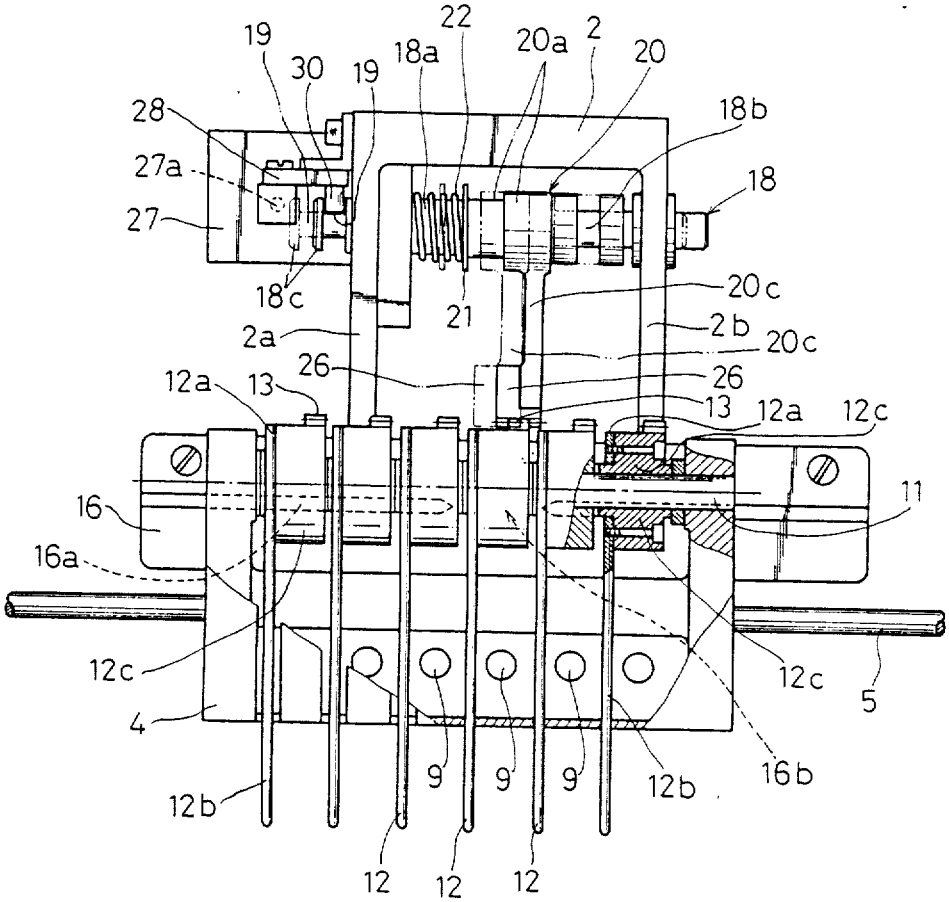
FIG. 4 is a plan view of FIG. 3, with certain parts omitted.

As shown in FIGS. 3 and 4, a longitudinal horizontally extending shaft 11 is provided in the rear portion of the needle bar case 4 adjacent the upper end thereof. Six thread take-up levers 12 corresponding to the respective needle bars 9 are pivotally fitted on the shaft 11. Each of the thread take-up levers 12 includes a base portion 12a substantially in the form of a disc through which the shaft 11 is loosely inserted, an arcuate arm portion 12b extending forwardly from the base portion 12a, and a boss 12c integrally formed with the side wall of the base portion 12a. The boss 12c has a gear portion 13 formed on a portion of the periphery thereof defined substantially between the rear end and the lower end. The base portion 12a and the boss 12c of the thread take-up lever 12 are formed in the outer periphery thereof with a common recess 14 opening downwardly when the thread take-up lever 12 is in the position shown in FIG. 3 (home position). The arm portion 12b is formed at the distal end thereof with a guide hole 15 through which a needle thread is passed.

A thread take-up lever guide 16 which is longer than the width of the needle bar case 4 is mounted on the upper surface of the arm 2 and extends below the base portions 12a of the thread take-up levers 12. The thread take-up lever guide 16 is provided with a guide rail 16a projecting therefrom and having a cutout portion 16b in the longitudinally central portion thereof. As shown in FIG. 4 in which the third needle bar 9 from the right is selected, the thread take-up levers 12 corresponding to the needle bars 9 other than the selected one have their recesses 14 engaged with the guide rail 16a, so that they may be held in the home position shown in FIG. 3. On the other hand, the thread take-up lever 12 corresponding to the selected needle bar 9 is located at the central cutout portion 16b of the guide rail 16a and has its recess 14 disengaged from the guide rail 16a, so that it may be swung.

Now, a description will be given to a thread take-up lever driving system for transmitting rotation of the main shaft 3 to the thread take-up lever 12 corresponding to the selected needle bar 9 (hereinafter referred to as "thread take-up lever in the operative position").

As shown in FIGS. 2 to 4, the driving system includes a cam 17 fitted on the main shaft 3 and is disposed within the arm 2. The cam 17 has an endless cam groove 17a formed on one side thereof.

Figure 5A:
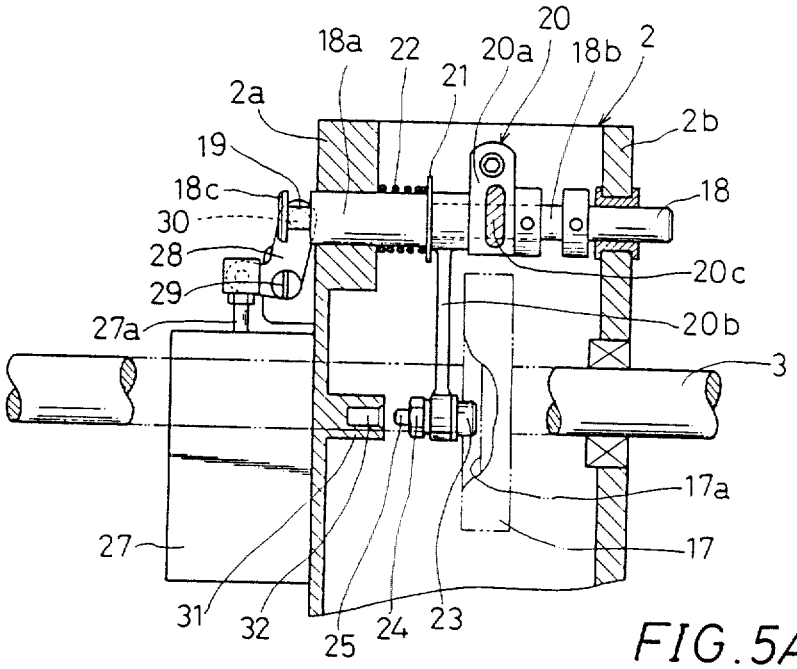
FIGS. 5A and 5B are vertical sectional views of the essential parts of the head, showing the interrelated movement of the transmission control mechanism and the retaining mechanism.
Figure 5B:
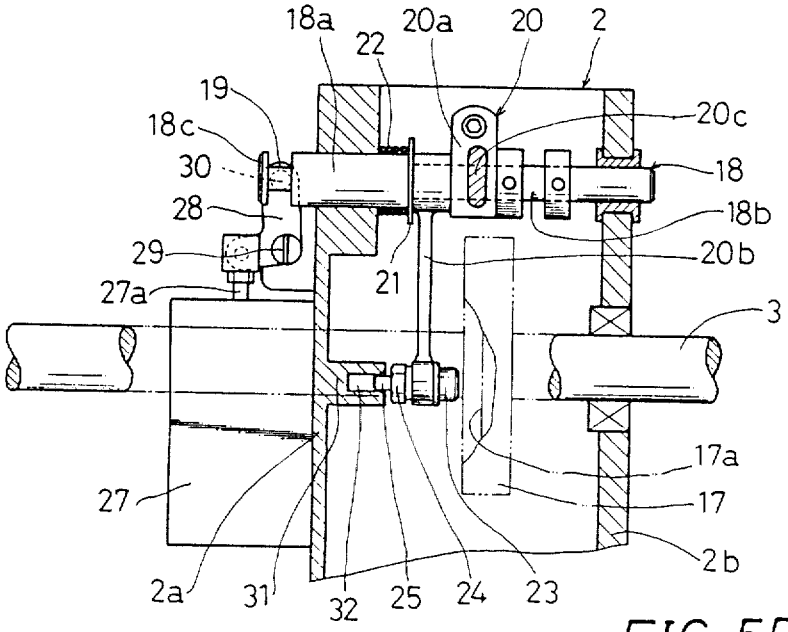

A movable shaft 18 longitudinally extends in parallel to the main shaft 3 above the cam 17 and is rotatably and axially slidably supported by the side walls 2a and 2b of the arm 2 at the rear upper portions thereof. As best shown in FIGS. 5A and 5B, the movable shaft 18 includes a large-diameter portion 18a and a small-diameter portion 18b joined longitudinally to each other. The movable shaft 18 further includes a flange 18c disposed outside of the large-diameter portion 18a, with an engaging section 19 defined therebetween and extending outwardly from the side wall 2a of the arm 2.

A movement transmitting member 20 is secured to the movable shaft 18 substantially at the medial portion thereof. As shown in FIG. 3, the movement transmitting member 20 includes a mounting portion 20a secured to the inner end of the small-diameter portion 18b of the movable shaft 18, a driven lever 20b extending downwardly from the mounting portion 20a, and a thread take-up lever driving lever 20c extending forwardly from the mounting portion 20a. As shown in FIG. 4, the movement transmitting member 20 further includes a flange 21 formed on one end of the mounting portion 20a. A spring 22 is provided between the flange 21 and the side wall 2a of the arm 2, encircling the large-diameter portion 18a. Thus, the movement transmitting member 20 is normally urged to the right (as seen in FIG. 4) under the biasing force of the spring 22.

As shown in FIGS. 5A and 5B, a cam follower 23 is provided on the driven lever 20b and is adapted to transmit rotation of the cam 17 to the movement transmitting member 20. Specifically, the cam follower 23 is fastened by a nut 24 to the distal end of the driven lever 20b and is received in the cam groove 17a of the cam 17. The cam follower 23 is provided with an integral lock pin 25 projecting outwardly from the nut 24. As shown in FIGS. 2 and 3, a sector gear 26 is secured to the distal end of the driving lever 20c of the movement transmitting member 20 and is adapted to mesh with the gear portion 13 of the thread take-up lever 12 in the operative position so as to transmit swinging movement of the movement transmitting member 20 to the thread take-up lever 12. When the main shaft 3 is rotated, with the cam follower 23 received in the cam groove 17a of the cam 17, the driven lever 20b is transversely swung about the movable shaft 18 in accordance with rotation of the cam 17. As this occurs, the driving lever 20c is vertically swung about the movable shaft 18, so that the thread take-up lever 12 is vertically swung about the shaft 11. The movement transmitting member 20 is so designed as to be stopped in the position shown in FIG. 3, whenever rotation of the main shaft 3 is stopped, and the thread take-up lever 12 in the operative position assumes the same position, that is the home position as the other ones, when the main shaft 3 is stopped. Therefore, selection of one of the needle bars 9 can be carried out only when the main shaft 3 is stopped.

As shown in FIGS. 2, 5A and 5B, a solenoid 27 is secured to the outer surface of the side wall 2a of the arm 2 and is operable to move the movement transmitting member 20 along with the movable shaft 18 in the axial direction of the movable shaft 18. The solenoid 27 has an actuating rod 27a which is pin-coupled at the distal end thereof to the lower end of an L-shaped crank member 28 pivotally mounted on the side wall 2a of the arm 2 through a pin 29. The crank member 28 has at the upper end thereof a transmission pin 30 projecting therefrom into engagement with the engaging section 19 of the movable shaft 18 so as to be moved therewith.

As shown in FIGS. 5A and 5B, the side wall 2a of the arm 2 is provided on the inner surface thereof with a projection 31 projecting therefrom at such a position as to be opposed to the lock pin 25 when the movement transmitting member 20 is in the position shown in FIG. 3, that is, when the thread take-up lever 12 is in the home position. The projection 31 has in the end surface thereof an engaging hole 32 into which the lock pin 25 can be inserted.

When the solenoid 27 is energized, the actuating rod 27*a* is lowered to pivot the crank member 28 in the counterclockwise direction. This causes the movable shaft 18 along with the movement transmitting member 20 to move to the left (as seen in FIGS. 5A and 5B) against the biasing force of the spring 22 and consequently, the cam follower 23 of the movement transmitting member 20 is disengaged from the cam groove 17*a* of the cam 17. Thus, the movement transmitting member 20 is released from its engagement with the cam 17, and at this time, the lock pin 25 is simultaneously inserted into the engaging hole 32. Even in this condition, the gear portion 13 of the thread take-up lever 12 is held in meshing engagement with the sector gear 26, as shown by broken lines in FIG. 4.

Thus, in the head H whose solenoid 27 is energized, rotation of the main shaft 3 will not cause swinging movement of the movement transmitting member 20 and thence the thread take-up lever 12. As the lock pin 25 is received in the engaging hole 32, the movement transmitting member 20 is restrained from its swinging movement. Further, as the sector gear 26 of the movement transmitting member 20 is held in meshing engagement with the gear portion 13 of the thread take-up lever 12, the thread take-up lever 12 can be held in the home position.

In the head H whose solenoid 27 has been energized as described above, when the solenoid 27 is deenergized with the main shaft 3 stopped, the movement transmitting member 20 is returned to its original position along with the movable member 18 under the biasing force of the spring 22. As this occurs, the lock pin 25 is disengaged from the engaging hole 32, and the cam follower 23 is received in the cam groove 17*a*. The head H is now returned to such a condition as to cause swinging movement of the thread take-up lever 12 by rotation of the main shaft 3.

The device thus constructed is operated as follows. When the sewing machine is desired to carry out a sewing operation by some of the heads H and to hold the other head H in their rest position, the needle bar 9 of each of the other heads H is held at rest by the stop signal, and, while the main shaft 3 is stopped, the corresponding solenoid 27 is energized. As described above, this causes the cam follower 23 of the movement transmitting member 20 to be disengaged from the cam groove 17*a* of the cam 17, so that, even when the main shaft 3 is rotated, the thread take-up lever 12 in the operative position will not be driven for reciprocation but will stand still. Thus, each head H in the rest position is relieved from the troubles of entanglement and fluffing of the needle thread and possible breakage thereof caused by swinging movement of the thread take-up lever 12 in the operative position. Further, in each head H held at rest, the thread take-up lever 12 in the operative position is held in the same home position as the other ones out of the operative position, permitting ready selection of a needle bar to be used, when the main shaft 3 is stopped.

When the main shaft 3 is stopped and the solenoid 27 of each head H which has been held at rest is deenergized, the cam follower 23 of the movement transmitting member 20 is engaged in the cam groove 17*a* of the cam 17, as described above, so that subsequent rotation of the main shaft 3 may be followed by swinging movement of the thread take-up lever 12 in the operative position.

Although the embodiment has been described in relation to a multi-head multi-needle sewing machine in which a plurality of needle bars 9 are supported in the needle bar case 4, it will be appreciated that the present invention is also applicable to a multi-head single-needle sewing machine in which a single needle bar 9 is supported in the needle bar case 4. In such a case, the guide rail 16 for holding the thread take-up lever 12 in the home position is not necessary. Further, as will be apparent to those skilled in the art, various changes and modifications may be made without departing from the sprit of the present invention which is defined by the appended claims.

What is claimed is:

1. In a multi-head sewing machine having a frame, a plurality of sewing heads mounted on said frame in longitudinally spaced relation to each other, each of said sewing heads having a bracket arm, a needle bar case disposed in front of said bracket arm and one or more thread take-up levers mounted on said needle bar case, and a main shaft extending through and rotatably supported by said bracket arms of said sewing heads, a device for driving any desired one of said thread take-up levers comprising:

movement converting means located within each bracket arm for converting rotational movement of said main shaft onto reciprocating movement thereof;

transmission control means operatively associated with said movement converting means for transmitting and disconnecting the reciprocating movement produced by said movement converting means to one of said thread take-up levers selected for sewing operation; and retaining means for retaining the selected take-up lever in a predetermined rest position when the reciprocating movement of said movement converting means is disconnected from the selected take-up lever by said transmission control means.

2. The device as defined in claim 1 wherein said movement converting means comprises a cam driven by said main shaft and a movement transmitting member releasably engaged with and reciprocatingly driven by said cam.

3. The device as defined in claim 2 wherein said transmission control means comprises a movable shaft rotatably and axially slidably supported by said bracket arm and fixedly connected to said movement transmitting member of said movement converting means, and an actuator means operatively connected to said movable shaft for moving said movement transmitting member in a direction in which said movement transmitting member is disengaged from said cam, whereby when said actuator means is actuated to axially move said movable shaft, said movement transmitting member is disengaged from said cam.

4. The device as defined in claim 2 wherein said retaining means comprises a retaining member mounted on said movement transmitting member and a restraining member disposed in opposed relation to said retaining member for restraining the movement of said retaining member when said movement transmitting member is disengaged from said cam.

5. The device as defined in claim 1 further comprising means for prohibiting swinging movement of the thread take-up levers other than the selected lever.

* * * * *